US009359872B2

(12) United States Patent
Legrand et al.

(10) Patent No.: US 9,359,872 B2
(45) Date of Patent: Jun. 7, 2016

(54) DOWNHOLE SYSTEM WITH FILTERING AND METHOD

(71) Applicants: Philippe J. Legrand, The Woodlands, TX (US); Jason J. Barnard, Katy, TX (US); Henry M. Sobczak, Cypress, TX (US)

(72) Inventors: Philippe J. Legrand, The Woodlands, TX (US); Jason J. Barnard, Katy, TX (US); Henry M. Sobczak, Cypress, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 136 days.

(21) Appl. No.: 14/283,569

(22) Filed: May 21, 2014

(65) Prior Publication Data

US 2015/0337633 A1 Nov. 26, 2015

(51) Int. Cl.
*E21B 47/01* (2012.01)
*E21B 43/08* (2006.01)

(52) U.S. Cl.
CPC ..... *E21B 43/086* (2013.01); *E21B 47/01* (2013.01); *E21B 47/011* (2013.01)

(58) Field of Classification Search
CPC ..... E21B 43/086; E21B 47/01; E21B 47/011
See application file for complete search history.

(56) References Cited

U.S. PATENT DOCUMENTS

| | | | | |
|---|---|---|---|---|
| 5,829,520 | A * | 11/1998 | Johnson | E21B 43/086 166/250.01 |
| 6,679,334 | B2 * | 1/2004 | Johnson | E21B 7/20 166/207 |
| 6,983,796 | B2 * | 1/2006 | Bayne | E21B 17/003 166/235 |
| 7,059,428 | B2 * | 6/2006 | Frey | E21B 43/086 175/40 |
| 7,757,758 | B2 * | 7/2010 | O'Malley | E21B 17/1078 166/206 |
| 7,866,405 | B2 * | 1/2011 | Richards | E03B 3/18 166/227 |
| 8,474,526 | B2 | 7/2013 | Bixenman et al. | |
| 8,950,472 | B2 * | 2/2015 | Harman | E21B 43/128 166/105 |
| 2002/0053439 | A1 | 5/2002 | Danos | |
| 2003/0000875 | A1 | 1/2003 | Echols et al. | |
| 2003/0056948 | A1 | 3/2003 | Cameron | |
| 2003/0221829 | A1 * | 12/2003 | Patel | E21B 47/123 166/278 |
| 2004/0149434 | A1 * | 8/2004 | Frey | E21B 43/086 166/250.1 |
| 2008/0121390 | A1 | 5/2008 | O'Malley et al. | |
| 2009/0173490 | A1 | 7/2009 | Dusterhoft et al. | |
| 2010/0018697 | A1 | 1/2010 | Richards et al. | |
| 2011/0297376 | A1 | 12/2011 | Holderman et al. | |
| 2012/0073804 | A1 * | 3/2012 | Harman | E21B 43/128 166/250.01 |

FOREIGN PATENT DOCUMENTS

EP 2045437 A2 4/2009

OTHER PUBLICATIONS

Notification of Transmittal of the International Search Report and the Written Opinion of the International Searching Authority, or the Declaration; PCT/US2015/024073; Mailed Jun. 29, 2015; ISR 7 pages; WO 8 pages.

* cited by examiner

*Primary Examiner* — Shane Bomar
(74) *Attorney, Agent, or Firm* — Cantor Colburn LLP

(57) ABSTRACT

A downhole system includes a tubular having a plurality of spaced apertures radially extending through a wall of the tubular. A section of the tubular blocking radial fluid flow through the wall between an interior and exterior of the tubular. The section arranged from a first end to a second end of the tubular. A plurality of filter pucks respectively inserted into at least some of the plurality of apertures. The filter pucks each including a body configured for insertion in one of the apertures and a filtering element within each body; and, at least one control or monitoring line arranged on the section. Further is a method of controlling sand in a downhole system.

18 Claims, 6 Drawing Sheets

DOWNHOLE SYSTEM WITH FILTERING AND METHOD

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration. Many of the world's oil and gas wells produce from unconsolidated sandstones that produce formation sand with reservoir fluids. Problems that are associated with sand production include plugging of perforation tunnels, sanding up of the production interval, accumulation in surface separators, and potential failure of downhole and surface equipment from erosion. Soft formation wells require specialized sand control completion practices to allow hydrocarbons or other fluids/gas or combination of to be produced without formation sand. While it is important to effectively prevent sand production, it is equally important to do so in a way that does not hinder a well's productivity.

Thus, liners, screens, and gravel packing have been employed in order to control formation sand production. Gravel packing is a completion procedure that is performed to prevent sand production from unconsolidated sandstone formations and high production rate wells. It consists of placing a screen or slotted liner in the borehole wherein the borehole may be an open hole or cased hole, then filling the perforation tunnels and the annular area between the screen and the casing or open hole with specially sized, highly permeable gravel pack sand. The formation sand bridges on the gravel pack sand, and the gravel pack sand bridges on the screen, such as wire-wrapped screens. For gravel packing, the gauge of the screen should be sized to prevent the passage of the gravel-pack sand. The screen diameter should be as large as possible and yet leave adequate room for packing gravel. The combined thickness of the screens, liners, and gravel pack must be taken into consideration as it reduces a maximum inner diameter of a production tubular and may ultimately limit production of downhole fluids.

Intelligent well systems are being more commonly employed to control anchor monitor downhole components. Such systems can assist in the collection and monitoring of downhole data and can be used to remotely control reservoir zones to optimize reservoir efficiency. Well monitoring instrumentation can measure pressures, temperatures, flow rates (towards the screens or the formation), water-cut, and density in the borehole with both electronic and fiber optic gauges. Intelligent completion technologies, such as zonally isolated, hydraulically adjustable valves and chokes, allow an operator to adjust product inflow from, or fluid injection to, a selected zone. Care must be taken to prevent damage to control lines during assembly, running control lines into a borehole, and during use.

The art would be receptive to improved and/or alternative apparatus and methods for combining sand control with intelligent well systems.

BRIEF DESCRIPTION

A downhole system includes a tubular having a plurality of spaced apertures radially extending through a wall of the tubular, and a section of the tubular blocking radial fluid flow through the wall between an interior and exterior of the tubular, the section arranged from a first end to a second end of the tubular; a plurality of filter pucks respectively inserted into at least some of the plurality of apertures, the filter pucks each including a body configured for insertion in one of the apertures and a filtering element within each body; and, at least one control or monitoring line arranged on the section.

A method of controlling sand in a downhole system, the method includes inserting a plurality of filter pucks into a plurality of radial apertures of a filtering tubular, the filtering tubular having a section blocking radial flow through a wall of the tubular, the section arranged substantially parallel to a longitudinal axis of the filtering tubular from a first end to a second end of the tubular; and, miming at least one control or monitoring line substantially parallel to the longitudinal axis of the filtering tubular in the section.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
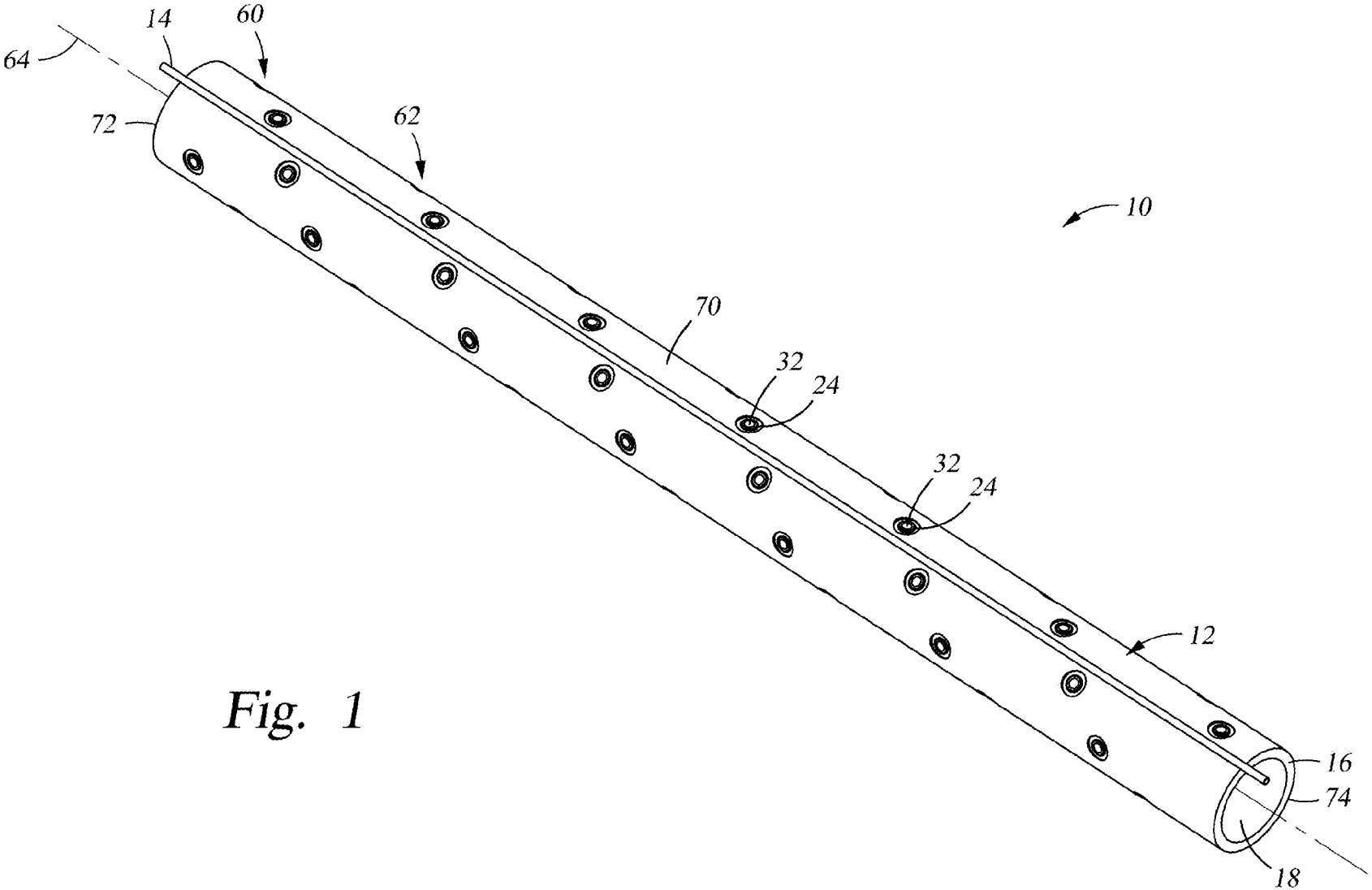
FIG. 1 shows a side plan view of an exemplary embodiment of a downhole system.
Figure 2:
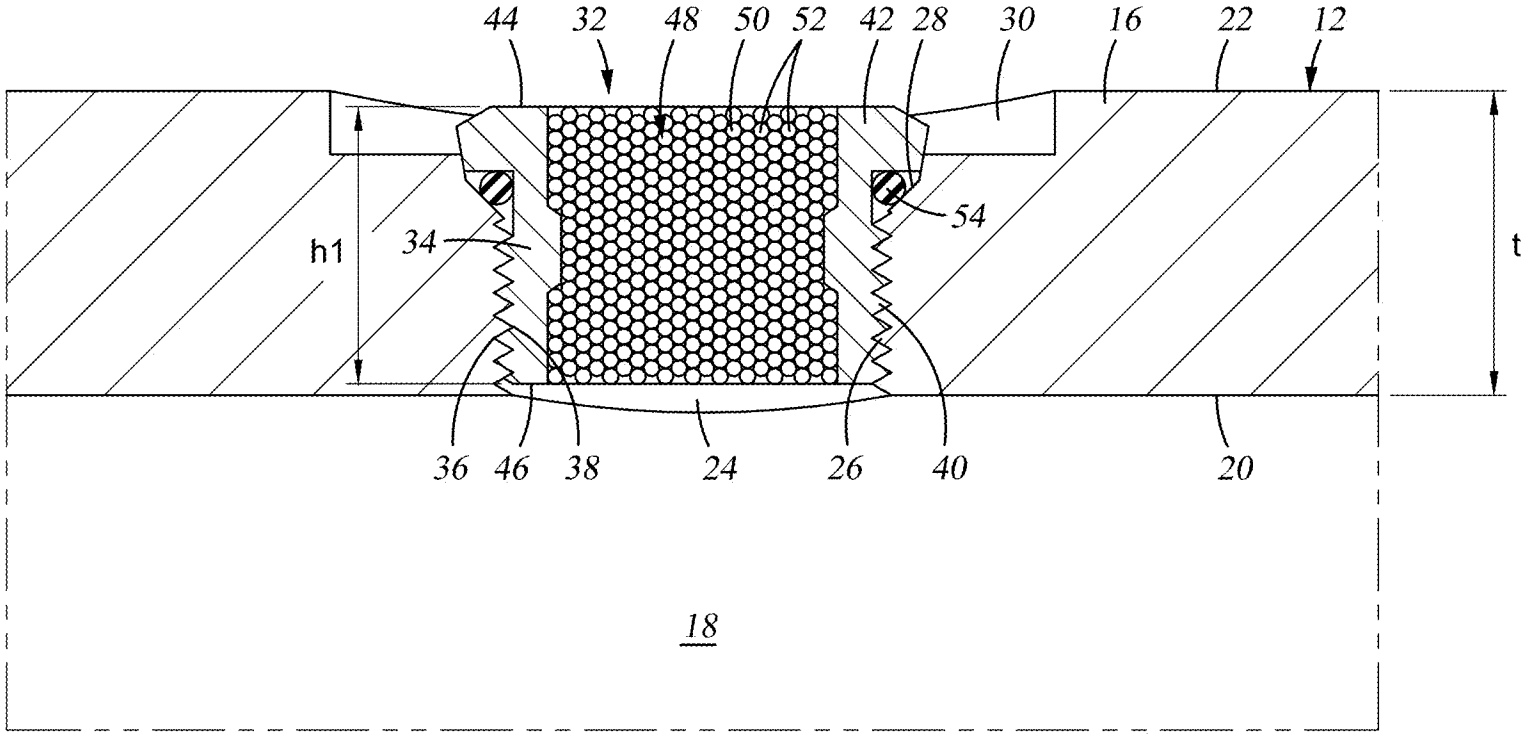
FIG. 2 shows a partial cross-sectional view of a filtering tubular and one exemplary embodiment of a filter plug for the downhole system of FIG. 1.
Figure 3:
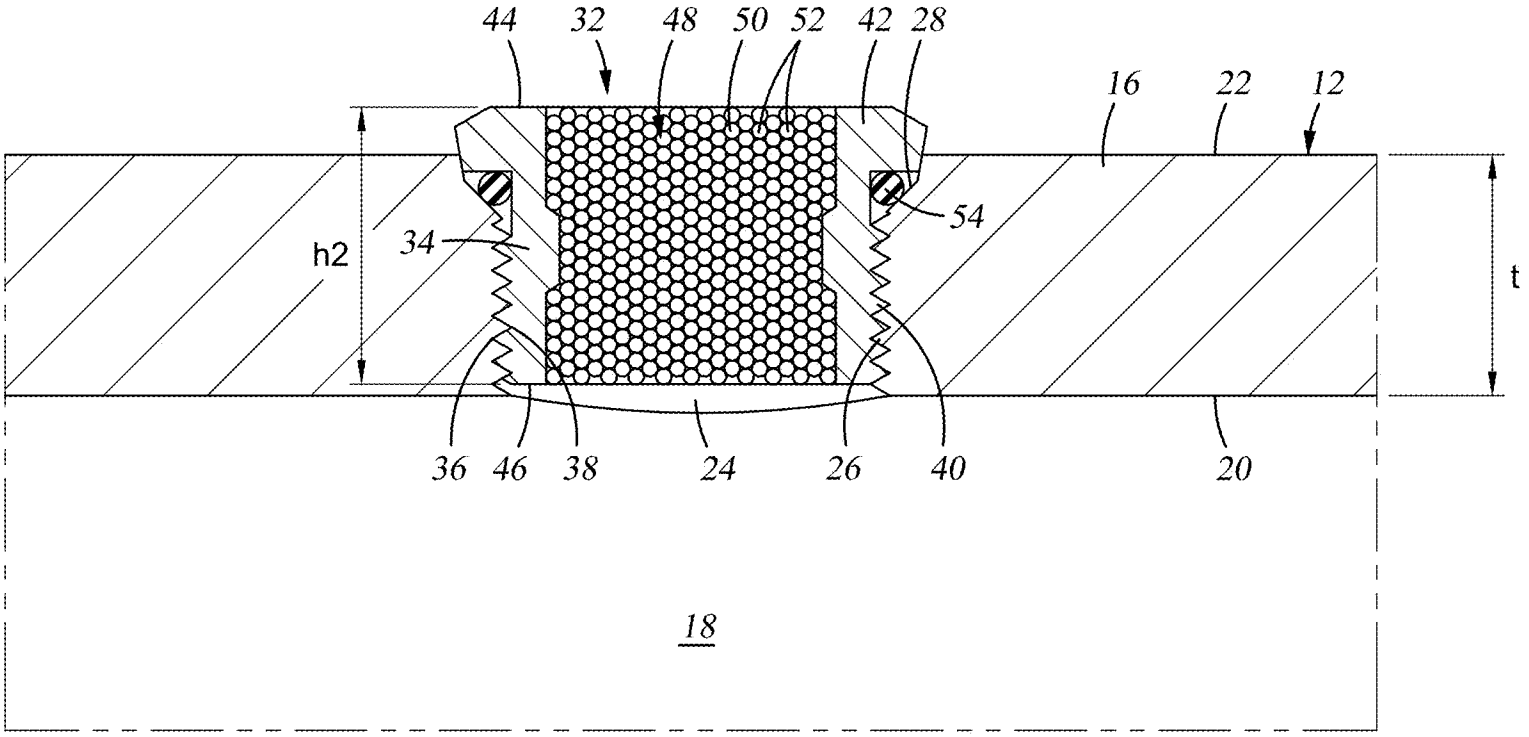
FIG. 3 shows a partial cross-sectional view of a filtering tubular and another exemplary embodiment of a filter plug for the downhole system of FIG. 1.

FIG. 1 shows one exemplary embodiment of a downhole system 10 including a filtering tubular 12, such as a casing, liner, or pipe, configured to receive at least one control or monitoring line 14 thereon. Thus, the downhole system is both a filtering system and an intelligent system. The filtering tubular 12 is sturdy and at least substantially inflexible so as to retain its inner diameter and not collapse inwardly, and may be made of steel or other metal suitable for downhole use. The filtering tubular 12 includes a tubular-shaped wall 16 and an interior 18 providing a main flow path for production fluids. As shown in FIGS. 2 and 3, the wall 16 of the filtering tubular 12 has a thickness t from an interior surface 20 to an exterior surface 22 of the wall 16. The wall 16 includes a plurality of spaced apertures 24 that may be dispersed about the wall 16 as shown in FIG. 1 and in a manner that will be further described below. The apertures 24 can extend from the interior surface 20 to the exterior surface 22 so as to have a length equal to the thickness t of the wall 16. The apertures 24 may include female threaded portion 26, such as the illustrated straight threads, to form a female threaded receptacle. The apertures 24 may further include a seal-receiving portion 28 between the threaded portion 26 and the exterior surface 22. In the exemplary embodiment shown in FIG. 2, the apertures 24 may open to a countersunk portion 30 at the exterior surface 22.

Figure 4:
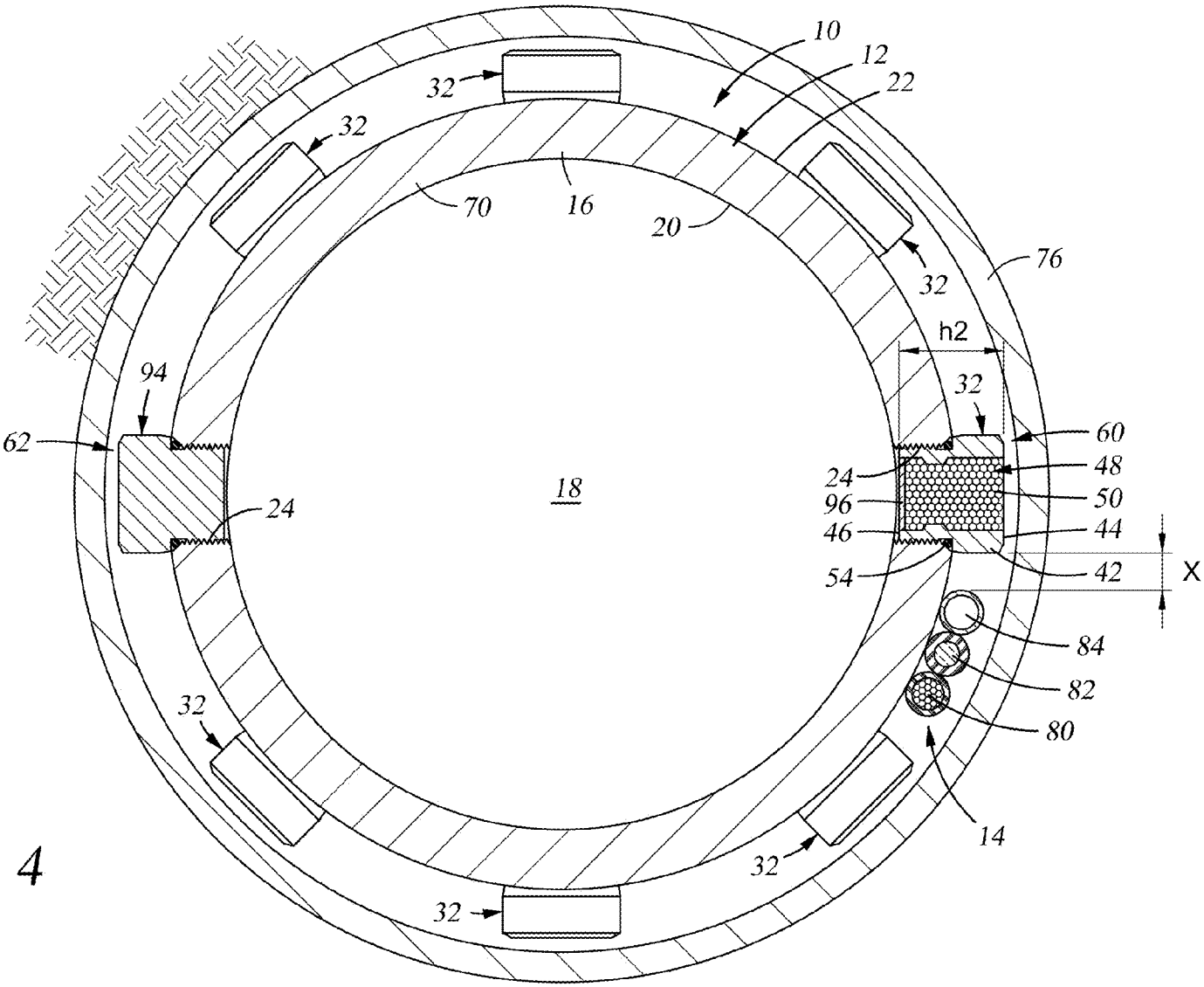
FIG. 4 shows a cross-sectional view of a downhole system having a plurality of lines and within a borehole or casing.

The apertures 24 are sized to receive a filter puck 32 or plug 94 (FIG. 4) therein. The filter puck 32 includes a substantially tubular body 34 having an exterior periphery 36 sized to engage with an inner periphery 38 of the aperture 24. In the embodiment where the aperture 24 includes female threaded portion 26, the exterior periphery 36 of the body 34 includes a male threaded portion 40 to engage with the female threaded portion 26 by threading the body 34 into the aperture 24. The body 34 may further include a head portion 42 having a larger outer diameter than the male threaded portion 40, such that the filter puck 32 cannot fall within the interior 18 of the filtering tubular 12. When inserted in the aperture 24, the head portion 42 is positioned closer to the exterior surface 22 than the interior surface 20. The head portion 42 is adjacent a first end 44 of the body 34, and a second end 46 of the body 34 is adjacent the interior surface 20 when inserted in the aperture 24. As shown in FIG. 2, the body 34 may have a height h1, from the first end 44 to the second end 46, substantially the same as that of the aperture 24 and thickness t of the wall 16 such that the filter pucks 32 are substantially flush with the exterior surface 22 of the filtering tubular 12. Alternatively, the body 34 may have a height h2 larger than the thickness t, as shown in FIG. 3. The height h2 may be large enough such that, as shown in FIG. 4, when the downhole system 10 is positioned within an outer tubular 76 such as a borehole, casing, or liner, the filter pucks 32 protrude further from the exterior surface 22 of the tubular 12 than a diameter of the at least one control or monitoring line 14 to protect the at least one control or monitoring line 14 from being bumped or scraped against the outer tubular 76 during run-in and in use. Alternatively, the filter pucks 32 may be configured to stand proud of the tubular 12, protruding from the exterior surface 22 of the tubular 12 at an alternative distance. For example, the height h2 of the filter pucks 32 may be the same or even less than the thickness t, but may be secured within the apertures 24 such that they protrude a selected distance from the exterior surface 22. Also, while a threaded connection has been described to secure the body 34 within the aperture 24, alternative configurations for securing the filter puck 32 into the aperture 24 are also within the scope of this invention.

The filter puck 32 further includes a filtering element 48 spanning an interior diameter or cross-sectional area of the body 34. The filtering element 48 may also extend the full length of the body 34, from the first end 44 to the second end 46, as shown in FIGS. 2 and 3, for maximum filtering capabilities with the dimensions of the body 34, or may alternatively be recessed from one or both ends 44, 46 of the body 34. In one exemplary embodiment of the filtering element 48, the filtering element 48 includes a bead pack 50 or bead screen including a matrix of bonded beads 52. The filtering element 48 is capable of preventing sand from entering into the interior 18 of the wall 16 of the filtering tubular 12, but allows passage of production fluids there through. The bonded bead matrix itself is described as "beaded" since the individual "beads" 52 are rounded though not necessarily spherical. A rounded geometry is useful primarily in avoiding clogging of the matrix since there are few edges upon which debris can gain purchase. While the bead pack 50 may be bonded stainless steel beads 52 having a brazed construction, the beads can alternatively be formed of many materials such as ceramic, glass, and other metals, and selected for particular resistance to downhole conditions. The beads may then be joined together, such as by sintering, for example, to form the bonded bead matrix of the bead pack 50 such that interstitial spaces are formed there between providing the permeability thereof. In some embodiment, the beads may be coated with another material for various chemical and/or mechanical resistance, or with a hydrophobic coating that works to exclude water in fluids passing there through.

Furthermore, each of the filter pucks 32 may optionally include a dissolvable membrane 96, as demonstrated in FIG. 4, at one or both of the first end 44 and second end 46 of the filter puck 32. The dissolvable membrane 96 may be dissolvable in the presence of downhole fluids over time such that production fluids do not enter the interior 18 of the filtering tubular 12 for a predetermined period of time. Alternatively, the dissolvable membrane 96 may be dissolved in the presence of an acid or other chemical selectively introduced at a time when production through the filter pucks 32 is desired. When the dissolvable member 96 is dissolved, the filtering element 48 remains intact and fluids may pass through the filtering element 48. An operator may selectively determine what type of filter puck 32 to insert within the filtering tubular 12 based on a particular intended operation.

A seal 54 may be provided between the body 34 and the aperture 24. More particularly, the seal 54 may be disposed at the seal-receiving portion 28 of the aperture 24 and between the head portion 42 and male threaded portion 40 of the body 34. The seal 54 may be a metal-to-metal ("MTM") seal, such as one taking the shape of an O-ring or other ring-shaped seal. The seal 54 is placed between the seal receiving portion 28 and the body 34 of the filter puck 32 during installation of the filter puck 32 into the aperture 24. The seal 54 ensures that flow into the interior 18 of the wall 16 of the filtering tubular 12 is restricted to flow via the filtering element 48 of the filter puck 32 rather than between the body 34 and inner periphery 38 of aperture 24.

With reference again to the exemplary embodiment of the filtering tubular 12 as shown in FIG. 1, the illustrated arrangement of apertures 24 will be described, however adjustments may be made to the configurations illustrated and described herein. The filter pucks 32 are arranged in one or more helical arrays 60, 62 with respect to a longitudinal axis 64 of the tubular 12 so as to limit the amount of filter pucks 32 found in any one perpendicular cross-section taken perpendicularly with respect to the longitudinal axis 64. For example, at a perpendicular cross-section such as shown in FIG. 4, the tubular includes only one aperture 24 and filter puck 32 and/or non-filtering, flow-blocking plug 94 from each of helical arrays 60, 62, although at other cross-sections, the tubular 12 includes only one aperture 24 and filter puck 32 or plug 94 from one of the helical arrays 60, 62, or no apertures 24 and no filter pucks 32 and plugs 94. The helical angle of the arrays 60, 62 may be adjusted to increase or decrease the number of apertures 24 within a longitudinal length of the filtering tubular 12. While the arrangement of apertures 24 in the filtering tubular 12 is not limited to the illustrated embodiment, from a manufacturing perspective, the arrangement is most readily formed if disposed in a replicable pattern. Also, as noted above, the amount of apertures 24 in any one perpendicular cross-section is limited so as to not jeopardize the structural integrity and strength of the filtering tubular 12, which must withstand large downhole pressures.

In order to employ the filtering tubular 12 within an intelligent downhole system 10, the filtering tubular 12 includes a non-filtering and radial-flow-blocking section 70 for allowing routing of a control or monitoring line 14 in a straight or substantially straight line, parallel or substantially parallel to the longitudinal axis 64. The radial arc of the section 70 includes a minimum arc length for accommodating one or more lines 14 therein, with each line 14 having a minimum distance x from an adjacent aperture 24, as more clearly seen in FIG. 4. With flow entering the tubular 12 through the filter pucks 32, the lines 14 are adequately spaced from the apertures 24, and do not cross-over any filter pucks 32, to prevent erosion of the lines 14 due to radial flow. Thus, while each array 60, 62 of apertures 24 may include substantially evenly spaced apertures 24, in one exemplary embodiment there are no apertures 24 within the section 70, which may require that adjacent apertures 24 within an array 60, 62 in the section 70 have a greater distance there between than other adjacent apertures 24 within the same array 60, 62. In such an exemplary embodiment, section 70 is a non-apertured, imperforate, solid-walled section through an entirety of its radial section. Alternatively, the section 70 may be created by filling in apertures 24 with plugs 94 to create the non-filtering flow-blocking section 70. In either embodiment, the section 70 extends from a first end 72 to a second end 74 of the filtering tubular 12.

Figure 6:
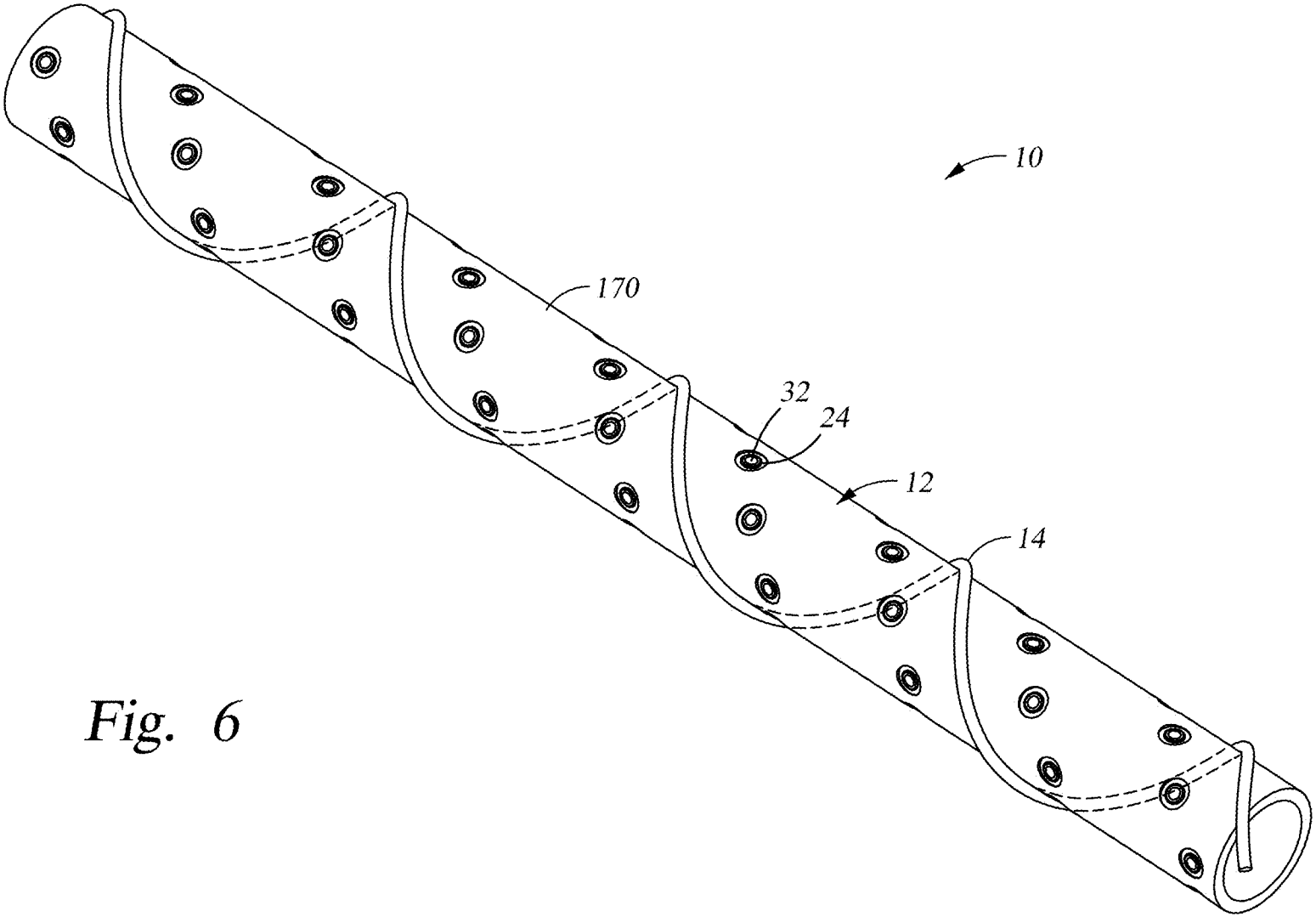

While running the control line or lines 14 in a straight line, parallel or substantially parallel to the longitudinal axis 64 provides a simple method for an operator to provide control lines 14 on the filtering tubular 12, under certain circumstances it may be preferable to run the line 14 in a helical pattern, in which case the section 170 is a helically arranged blank section free of filtering elements as shown, for example, in FIG. 6, for running the control line 14 thereon. As with the section 70, the section 170 may be created by providing a non-apertured imperforate, solid-walled helical section through the section 170, or alternatively by creating the section 170 by filling in any apertures 24 with plugs 94 to create the section 170.

Figure 5:
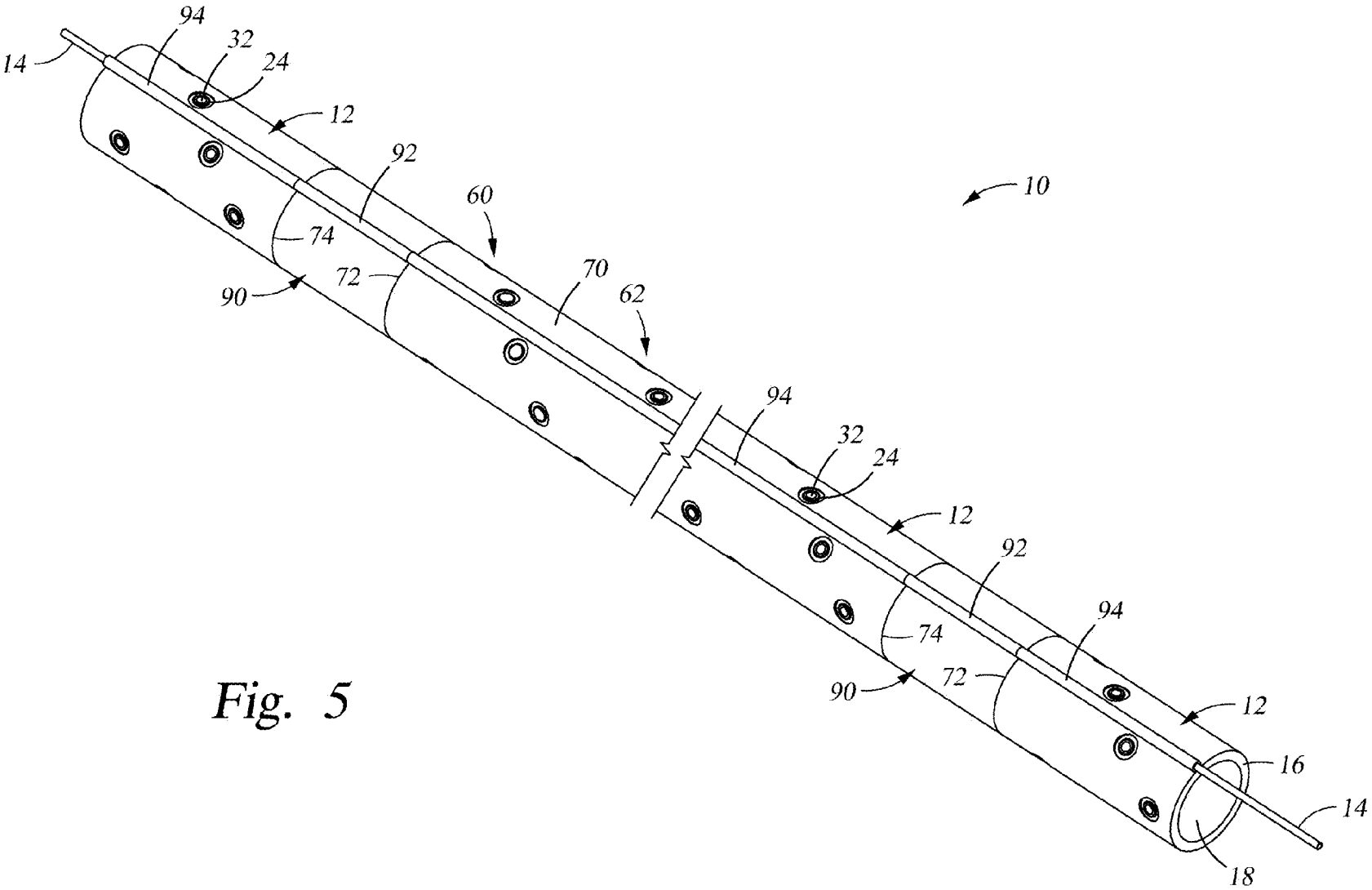
FIG. 5 shows a side plan view of an exemplary embodiment of a downhole system including end clamps for securing a line to the filtering tubulars; and, FIG. 6 shows a side plan view of another exemplary embodiment of a downhole system.

The line or lines 14 may include one or more of electrical lines 80, fiber optic lines 82, hybrid fiber electric lines, and hydraulic lines 84, as shown in FIG. 4. With reference to FIG. 5, the line or lines 14 are clamped or otherwise secured at ends 72, 74 of each filtering tubular 12. For example, a locking mechanism sub 90 may be secured between two adjacent longitudinal ends 72, 74 (or in between thereof) of adjacent filtering tubulars 12. The locking mechanism sub 90 may include a hinged clamp with passageway 92 for the line or lines 14. Adjacent locking mechanism subs 90 may further include interconnecting line protectors 94 that cover the lines 14 that extend along the tubular 12 that is interposed therebetween. Alternative protective covers or shrouds may also be employed with the downhole system 10 as needed to protect the line or lines 14 from damage during particular operations. This also includes use of elastomeric material for protection.

The above-described downhole system 10 enables a method of controlling sand from being produced with production fluids. The method includes inserting a plurality of filter pucks 32 into a plurality of apertures 24 of a filtering tubular 12 and running a line 14 substantially parallel to a longitudinal axis 64 of the filtering tubular 12 in a non-filtering, flow-blocking, and/or non-apertured section 70 of the filtering tubular 12. The downhole system 10 includes a larger inner diameter than a conventional filtering system that employs both a production pipe and a screen wrap, thus affording more production volume. That is, due to the removal of a previous screen wrap, the production pipe, or in this case the filtering tubular 12, can be enlarged to occupy the space previously occupied by the screen wrap, thus increasing the inner diameter allotted to production flow, which in these embodiments is the inner diameter of tubular 12. Also, the use of filter pucks 32 as opposed to screen wraps allows for replaceability of one filter puck 32 at a time if needed, as opposed to having to replace an entire screen wrap if there is damage. Furthermore, the filtering tubular 12 is a modular device in that the apertures 12 may accommodate the filter pucks 32 as shown, but may also accommodate plugs 94 such that the arrangement of flow ports into the interior 18 of the filtering tubular 12 can be varied as determined by an operator prior to running the system 10 into a borehole. That is, while a particular filtering tubular 12 will be provided with a certain number of apertures 24, not all of the apertures 24 need to be employed for production and some of the apertures 24 may be plugged using plugs 94. Thus, the method includes selecting a number of flow ports to be employed for a particular operation. The plugs 94 may be used to create the non-filtering and flow-blocking section 70, that is, by blocking flow into the interior 18, the lines 14 would be protected from radial flow. The same filtering tubular 12 may also be used to accommodate filter pucks 32 with or without a dissolvable membrane 96 as described above. Also, the downhole system 10 is specifically designed to easily accommodate one or more control or monitoring lines 14 thereon in a straight manner and without fear of eroding the lines 14 by the filter pucks 32.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A downhole system comprising:

a tubular having a plurality of spaced apertures radially extending through a wall of the tubular, the apertures arranged in at least one helical array, and a section of the tubular blocking radial fluid flow through the wall between an interior and exterior of the tubular, from a first end to a second end of the tubular, the section extending substantially parallel to a longitudinal axis of the tubular;

a plurality of filter pucks respectively inserted into at least some of the plurality of apertures, the filter pucks each including a body configured for insertion in one of the apertures and a filtering element within each body; and, at least one control or monitoring line arranged on the exterior of the tubular within the section, the at least one control or monitoring line extending substantially parallel to the longitudinal axis of the tubular;

wherein radial fluid flow through the wall is simultaneously blocked by the section of the tubular and permitted by the filter pucks, and a radial arc length of the section is greater than a combined width of the at least one control or monitoring line.

2. The system of claim 1 wherein the filtering element includes a bonded bead pack configured to block sand from entering an interior of the tubular and to allow fluids to flow through the filtering element.

3. The system of claim 2 wherein the bonded bead pack includes a matrix of bonded stainless steel beads.

4. The system of claim 1 wherein a height of the body and a thickness of the wall of the tubular are substantially the same.

5. The system of claim 1 wherein the filter pucks attached to the tubular protrude from an exterior surface of the tubular.

6. The system of claim 5 wherein the filter pucks protrude further from the exterior surface of the tubular than a diameter of the at least one control line or monitoring line to protect the at least one control line or monitoring line.

7. The system of claim 1 wherein the section is non-apertured and the plurality of apertures are substantially evenly spaced about the tubular except for in the section.

8. The system of claim 1 wherein the body of each filter puck includes a retaining mechanism configured to retain the body within one of the plurality of spaced apertures.

9. The system of claim 1 further comprising a seal interposed between at least one of the plurality of filter pucks and respective aperture.

10. The system of claim 1 further comprising at least one flow-blocking plug insertable within at least one of the plurality of apertures, the at least one flow-blocking plug not including a filtering element and not including a dissolvable member.

11. The system of claim 10 wherein the at least one flow-blocking plug is positioned within an aperture amongst the at least one of the plurality of apertures in the section.

12. The system of claim 1 wherein the filter pucks further comprise a dissolvable membrane to delay a filtering action of the filter pucks.

13. A method of controlling sand in a downhole system, the method comprising:

inserting a plurality of filter pucks into a plurality of radial apertures of a filtering tubular, the apertures arranged in at least one helical array, the filtering tubular having a section blocking radial flow through a wall of the tubular from a first end to a second end of the tubular, the section arranged substantially parallel to a longitudinal axis of the filtering tubular; and, running at least one control or monitoring line substantially parallel to the longitudinal axis of the filtering tubular in the section;

wherein radial fluid flow through the wall is simultaneously blocked by the section of the tubular and permitted by the filter pucks, and a radial arc length of the section is greater than a combined width of the at least one control or monitoring line.

14. The method of claim 13, wherein inserting a plurality of filter pucks into a plurality of apertures includes inserting a plurality of filter pucks, each having a body surrounding a filtering element including a matrix of bonded metal beads, into the plurality of apertures.

15. The method of claim 13, further comprising inserting a plurality of flow-blocking plugs into a plurality of apertures in the filtering tubular to alter the arrangement of flow ports in the filtering tubular, the plurality of flow-blocking plugs not including a filtering element and not including a dissolvable member.

16. The method of claim 13, further comprising creating the section by inserting a flow-blocking plug into any of the plurality of apertures located within the section designated to accommodate the at least one control or monitoring line, the flow-blocking plug not including a filtering element and not including a dissolvable member.

17. The method of claim 13, further comprising protecting the at least one control or monitoring line by protruding portions of the plurality of filter pucks attached to the filtering tubular above an exterior surface of the filtering tubular.

18. The method of claim 13, further comprising threading the plurality of filter pucks into the plurality of apertures such that a first end of the plurality of filter pucks is substantially flush with an exterior surface of the filtering tubular.

* * * * *